United States Patent [19]

Rylewski

[11] 4,090,825

[45] May 23, 1978

[54] PLATE WITH PASSAGES FOR FLUID ROTATIVE MACHINES

[76] Inventor: Eugeniusz M. Rylewski, 43 bis, Avenue du Gal Leclerc, 78470 St. Remy les Chevreuse, France

[21] Appl. No.: 655,538

[22] Filed: Feb. 5, 1976

[30] Foreign Application Priority Data

Feb. 7, 1975 France ..... 75 03977

[51] Int. Cl.[2] ..... F01C 1/00; F01C 21/00; F03C 3/00; F04C 1/00

[52] U.S. Cl. ..... 418/178; 418/226; 418/234

[58] Field of Search ..... 418/178, 218, 226, 234

[56] References Cited

U.S. PATENT DOCUMENTS

| | | | |
|---|---|---|---|
| 1,304,497 | 5/1919 | Maxam | 418/226 |
| 1,367,801 | 2/1921 | Clark | 418/226 |
| 2,090,280 | 8/1937 | Biermann | 418/218 |
| 2,141,982 | 12/1938 | Good | 418/226 |
| 3,827,835 | 8/1974 | Higuchi et al. | 418/178 |

*Primary Examiner*—John J. Vrablik
*Attorney, Agent, or Firm*—Morgan, Finnegan, Pine, Foley & Lee

[57] ABSTRACT

In a rotative machine for fluids which includes a plate formed with spiral-like passages extending from a central orifice to an annular interval and which also includes, facing the passages, a support rotatably mounting vane wheels for rotation about axes which are perpendicular to the axis of rotation of said plate, the vanes of said vane wheels have a dimension at their attachment to the body of the vane wheels which is different from that at their frontal side, permitting manufacture of the plate by simple die-casting. A method is also provided for determining the contour for both the passages and the cooperating sliding surfaces of the plate and the support for the vane wheels which will result in the maximum output for the machine.

12 Claims, 15 Drawing Figures

PLATE WITH PASSAGES FOR FLUID ROTATIVE MACHINES

The object of the present invention is to provide a plate with passages for rotative machines for fluids which may be formed by a simple casting operation and in which both the contour of the passages and of the cooperating sliding surfaces of the plate and vane wheels support is of a predetermined configuration to provide a maximum output for the machine.

The following French patents were each filed in the name of the present applicant:

No. 71 20194 of June 3, 1971 for "Driving or driven machines for liquids";

No. 71 20195 of June 3, 1971 for "Driving or driven machines for gases"; and

No. 71 20196 of June 3, 1971 for "Gas turbine".

Each of the above patents concerns rotative machines for fluids which include a plate with spiral-like passages or grooves in which circulate the vanes of vane wheels which, in turn, are carried by a support which rotates relative to the plate. The vane wheels distributed around the support rotate about axes which are transverse to the axis of rotation of the support and of the plate.

In the aforementioned machines, each of the passages has a profile conjugated with the lateral sides and the frontal side of the vanes. The lateral surfaces, therefore, have a variable inclination in relation to the axis of rotation along the constituent spiral of a passage. The vanes, having a substantially rectangular contour, function in the nature of pistons during their travel in the passages, the conduits for the circulation of fluid bordered by the said passages being completed by the surface of the support for the vane wheels, which support surface slidingly contacts the crests or ridges of the ribs, or lateral sides, bordering the passages.

Thus, the crests or ridges of the ribs defining the passages are formed on a surface of revolution and the machining of such a plate with passages by removing the chips is an operation which is relatively complicated and costly. Also, up to now, it has not been possible to cast such a plate by any simple method. Thus, the cooperation of the vanes with the passages leads, indeed, to an inclination of the passages in relation to the axis which necessarily produces a negative rake over, at least, a portion of the length of the passage, which does not allow such a plate to be cast with a one-piece die.

The present invention copes with this difficulty. It is based on the provision of vane wheels whose vanes have converging sides, the base at the attachment of each vane to the body of the wheel being larger than the frontal side of the vane. Thus, although the lateral faces of a passage have constantly changing inclination in relation to the axis of rotation, the said cooperating passages of the plate always can have a slope on the same side in relation to the direction of the axis of rotation. In other words, it can always have a positive rake despite the variation of the said inclination along the passage.

The configuration of the vanes of the vane wheels of the present invention thus generally is in the form of a trapezoid, in which the converging sides may be either rectilinear or convexly curved. In the latter embodiment, the contour of the vanes preferably resembles that of a tooth of a gear with sides analogous to an involute of a circle and thus comprises, starting from the attachment of the body of the wheel, an incurved portion, then, a frontal side concentric to the axis of rotation of the wheel and, finally, a second incurved portion, symmetrical to the first incurved portion in relation to the mean radius of the vane. Alternatively, the contour of the vanes may be semi-circular, the center of the half-circle being on the circumference limiting the body of the wheel.

In all cases the transverse section of the passages in which the vanes of the vane wheels circulate is conjugated with the contour of said vanes.

It is, therefore, possible to cast a plate with the passages without the difficulty of stripping off the casting, which can be done by simple removal of the one-piece die from the plate in a direction parallel to the axis thereof.

The machine part with the passages obtained by casting can be, if it is needed, machined afterwards, particularly at the bottom of the passages, to obtain the required precision.

In another embodiment, the required precision is obtained by an overcast of a layer of coating in plastic material.

In another embodiment, the plate is manufactured from a block in plastic material and the impression of the die forms the ribs in the said plate with a precision sufficient to avoid any subsequent machining.

The invention covers also an alternative, according to which the passages are formed by obtaining the ribs separately and subsequently mounting them onto the body of the plate.

The present invention also provides for a method for the determination of the contour of a vane, and consequently, for the transverse section of the passages, which ensures a maximum output for a machine of a predetermined general structure while complying with the conditions imposed by the manufacturing of a plate with spirals by casting.

The invention applies both to the rotative machines in which the cooperating surfaces of the plate containing the fluid passages and of the support rotatably mounting the vane wheels sliding one against the other are flat, and to machines in which the said surfaces are incurved.

In the latter case, the invention also provides for a method according to which the shape of the aforesaid cooperating surfaces of the plate and support are determined in such a way as to give for a given contour of the vane and a given transverse section of the passages, a machine of maximum output.

In the following description, made as an example, reference is made to the accompanying drawings, in which.

Figure 1:
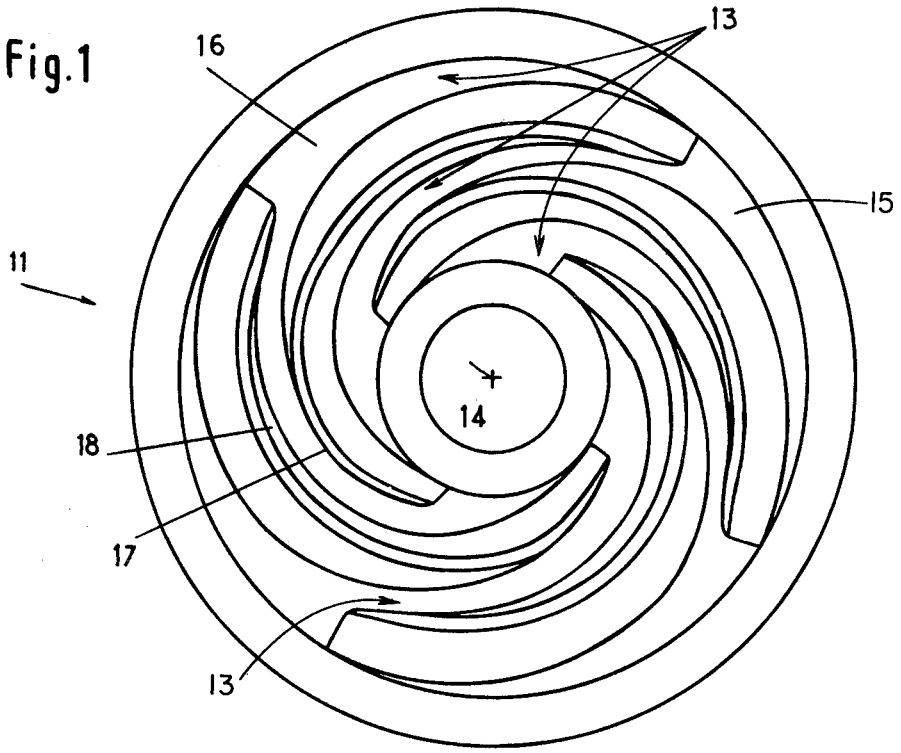
FIG. 1 is a front view of a plate with spiral-like passages constructed in accordance with a first embodiment of the invention.
Figure 4:
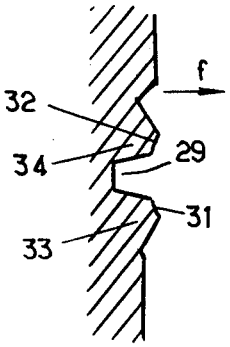
FIG. 4 is a fragmentary view in transverse section of the plate of FIG. 1.
Figure 5:
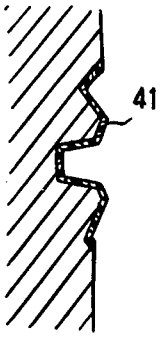
FIG. 5 is a view similar to FIG. 4, illustrating an alternate embodiment of the method of manufacture of the invention.
Figure 6:
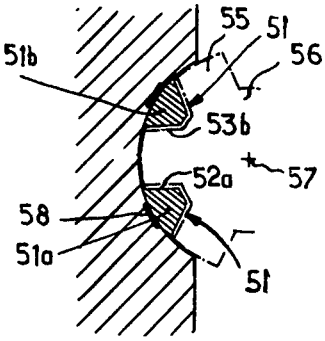
FIG. 6 is a view similar to FIGS. 4 and 5, illustrating another alternate embodiment of the method of manufacture of the invention.
Figure 3:
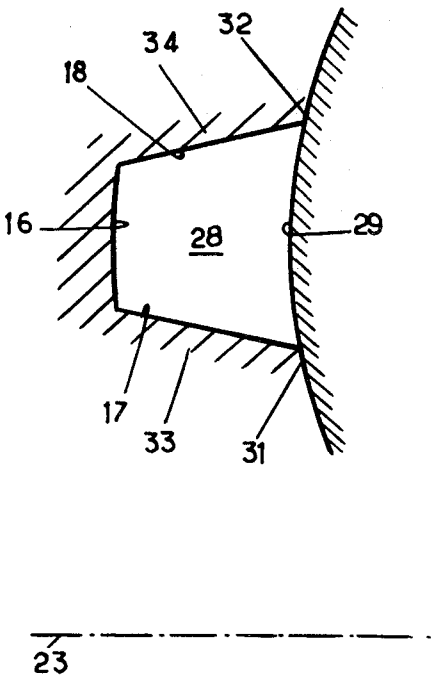
FIG. 3 is an enlarged view in axial section of a part of the plate shown in FIGS. 1 and 2 with a cooperating part of the support for the vane wheels.
Figure 2:
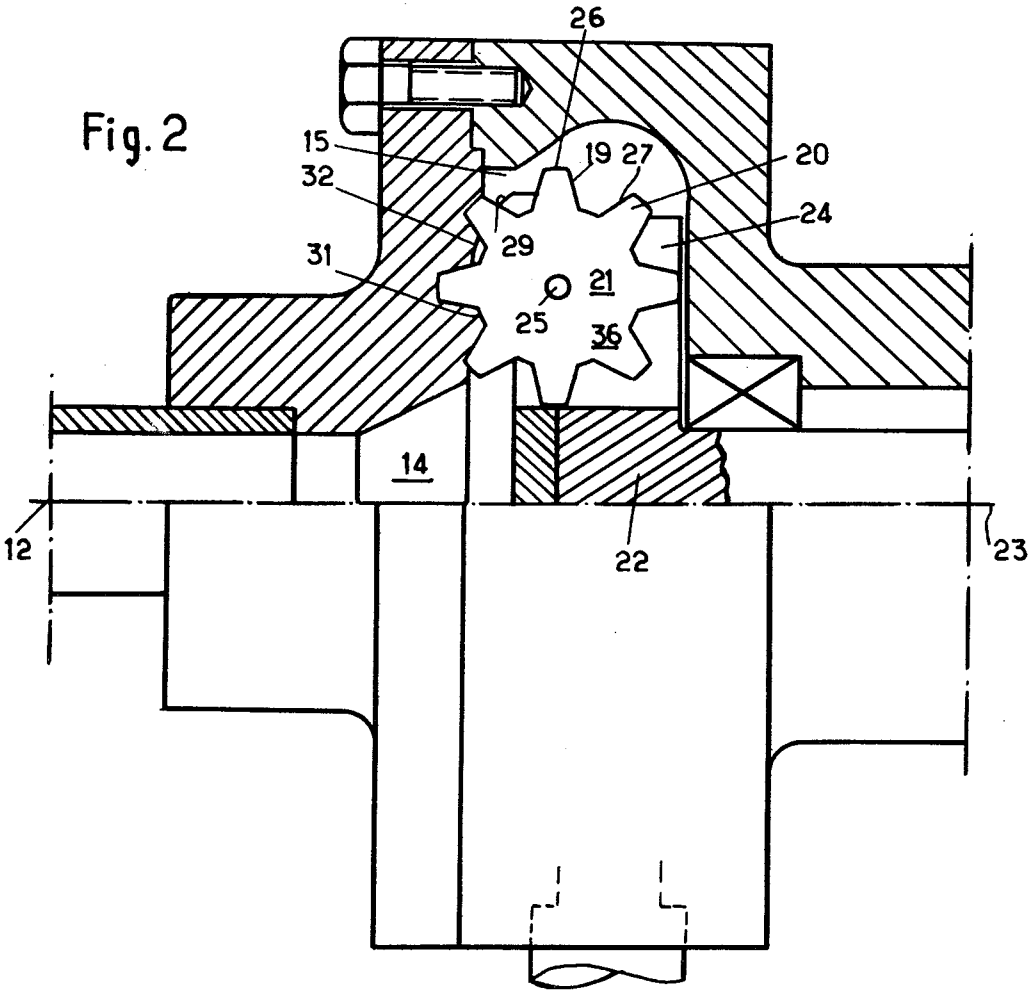
FIG. 2 is a view in axial section of a rotative machine for fluids including a plate constructed as shown in FIG. 1 and a vane wheel cooperating therewith.

Referring now more particularly to FIGS. 1–6 of the accompanying drawings, the plate 11 (FIG. 1) has, regularly distributed around the axis 12, a certain number of passages 13, in the form of spirals, which have their inlet openings adjacent to a central orifice 14 and their outlet openings adjacent to an annular interval 15. The passages are bordered by a bottom 16, an internal lateral surface 17 and an external lateral surface 18.

A vane wheel 21, the plane of which is parallel to the axis 12, is housed in a longitudinal slot 24 formed in a support 22 for the vane wheels which is mounted for rotation relative to the plate 11 around the axis 23. Vane wheel 21 is mounted for rotation around the axis 25, which is perpendicular to the plane of the wheel 21 and perpendicular to the axis 23.

The external lateral surface 18 of a passage is a portion of the conjugated surface with the surface described by the lateral side 19 of a vane 20 (FIG. 2) belonging to a vane wheel 21.

The bottom 16 of the passage is conjugated with a portion of the surface described by the frontal side 26 of the vane 20. The internal lateral surface 17 is conjugated with a portion of the surface described by the other lateral side 27 of the vane.

The conduit 28 (FIG. 3) defined by the passage is completed by a surface 29, which is formed on the support 22 for the vane wheels 21, which cooperates slidingly with the surfaces 31 and 32 bordering the passage and which can be considered as ridges or tops of the ribs 33 and 34, also of a spiral-like shape, and the opposite faces of which are also the lateral surfaces 18 and 17 of the conduit 28.

The inclination of the flanks 17 and 18 relative to the axis 12 is constantly variable along the passage on account of the fact that during the rotation of the support 22 in relation to the plate 11, the vane wheels 21 rotate around their own axes 25.

According to the present invention, the inclination of lateral sides 19 and 27 of the vanes 20 is chosen such that, in relation to the frontal side 26, the surfaces 17 and 18 which constitute the external and internal lateral surfaces of the passages 13 always point in a direction such that, starting from the junction with the bottom 16, they move in a direction away from a line parallel to the axis of rotation 12.

The vanes 20 have, thus, a trapezoidal contour, the portion thereof which attaches to the body 36 of the wheel being larger than the frontal side 26 thereof.

The conditions for the circulation of fluids in a machine comprising a plate 11 with passages 13 and vane wheels 21 are equally satisfied as with vane wheels whose vanes are of rectangular shape and with a plate having passages conforming thereto.

Plate 11 can be obtained by casting with a die having projections conjugated with the passages to be obtained. The withdrawal of the die by moving away in the direction of the arrow *f* parallel to the axis 12 (FIG. 4) does not present any inconvenience as none of the surfaces of the die have a negative angle or negative rake. Therefore, the die can be made in one piece.

The present invention also provides for the manufacture of a plate with passages by casting or stamping a metal blank which is then additionally machined in particular on the lateral faces of the passages and possibly also at the bottom of the passages.

The casting or stamping allows ridges, such as 31 and 32 of the ribs 33 and 34, to be obtained, lying on a curved surface or on a flat surface.

In an alternative embodiment of the method of manufacture of the invention (FIG. 5), the passages of a metal plate obtained by casting have their faces covered, advantageously by overcoating, with a lining 41 in plastic material, or in rubber, whose surface finish is adequate of the cooperation with the vanes of vane wheels.

In another alternative embodiment of manufacture, the whole plate with the passages is formed from plastic material and is thereafter obtained by casting.

In still another alternative embodiment of manufacture, the ribs bordering the passages are manufactured separately, for example by casting, in separate pieces with a spiral-like contour, with the lateral faces perpendicular or not to the bottom and the said pieces are then mounted on the body of the plate, for example by bolting, welding or otherwise. Such an embodiment is shown on FIG. 6. The spiral-like strips 51 are manufactured separately by casting. The external lateral face **52*a* of the strip 51*a*, the internal lateral face 53*b* of the strip 51*b* and the surface 29 of the plate 11 border spiral-like passages with which cooperate the vanes 55 of a vane wheel 56 mounted for rotation around the axis 57**.

The means for fastening strips 51 to plate 11 are schematized at 58.

In this last embodiment, vane wheels with rectangular vanes can be adopted and are illustrated. It is also possible in the embodiment of FIG. 6 to adopt vane wheels with vanes having a width smaller at their attachment than at their frontal side, the passages with which the vanes cooperate having, therefore, a bottom larger than the interval of introduction of the passages. This results in a machine of increased capacity.

In an alternative, the ribs have constant thickness, so that they can be obtained by rolling.

A plate according to the present invention can be utilized as a constituent part of a rotative machine for compressible or incompressible fluids, and the machine may be driving or driven.

Referring now to FIGS. 7–15 of the accompanying drawings, the machine there illustrated (FIG. 7) includes a rotor 112 and a flat stator 113 which have flat surfaces which cooperating slidingly one with the other, respectively designated 111R and 111S, perpendicular to the axis 114 of rotation of the rotor in relation to the stator.

Rotor 112 comprises a body 115 and vane wheels 116 housed in slots 117 of the rotor body and mounted for rotation around axes 118. The vanes 119 of a vane wheel 116 circulate in the passages 121 of the stator 113. The passages are spiral-like in form between a central ring 122 of the stator and a peripheral ring 123. The passages 121 have a transverse section conjugated with the contour of the vanes 119, the latter cooperating, therefore, with the fluid contained in the channel limited by a passage and the facing portion of the surface 111R of the rotor.

Figure 7:
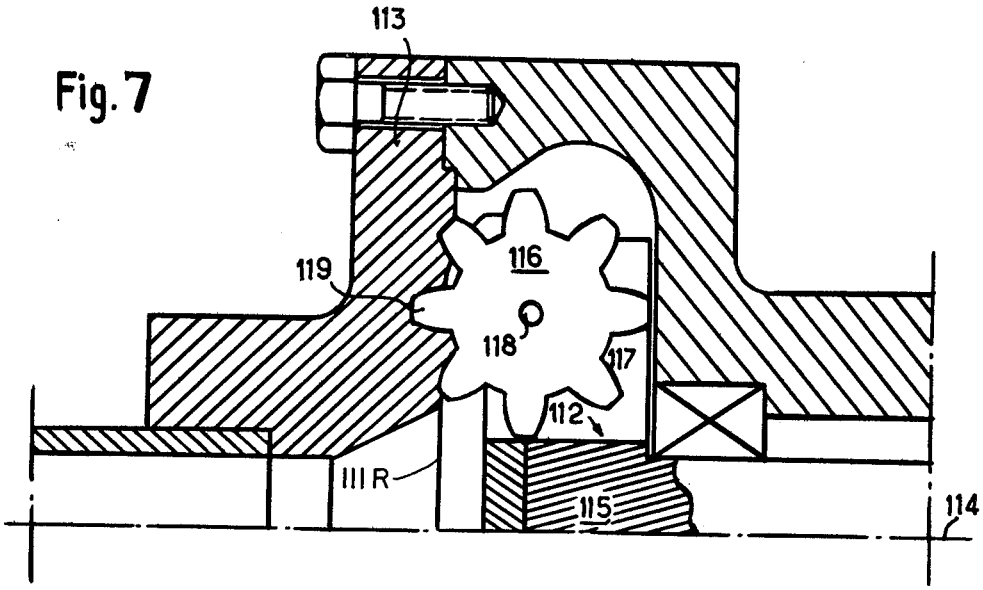
FIG. 7 is a view in axial section of a rotative machine for fluids including a plate with spiral-like passages constructed in accordance with a second embodiment of the invention.
Figure 9:
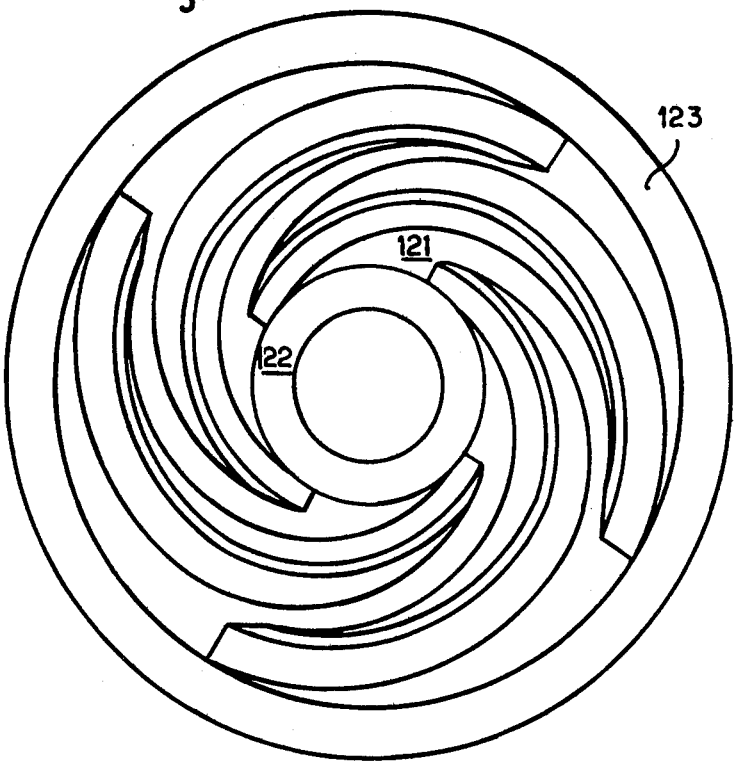
FIG. 9 is a front view of the plate of FIG. 7.
Figure 8:
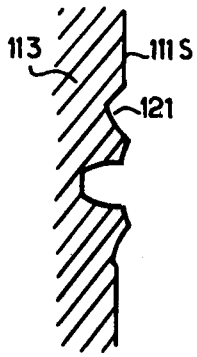
FIG. 8 is a fragmentary view in transverse section of the plate of FIG. 7.

In accordance with the invention, the profile of a vane of the vane wheels and, consequently, the shape of the transverse sections of the passages of the stator may be predetermined so as to manufacture the stator of a machine as shown in FIGS. 7 and 9 by casting with a one piece die movable parallel to the axis 114 and yet so as to provide such a machine with a maximum output.

Figure 10:
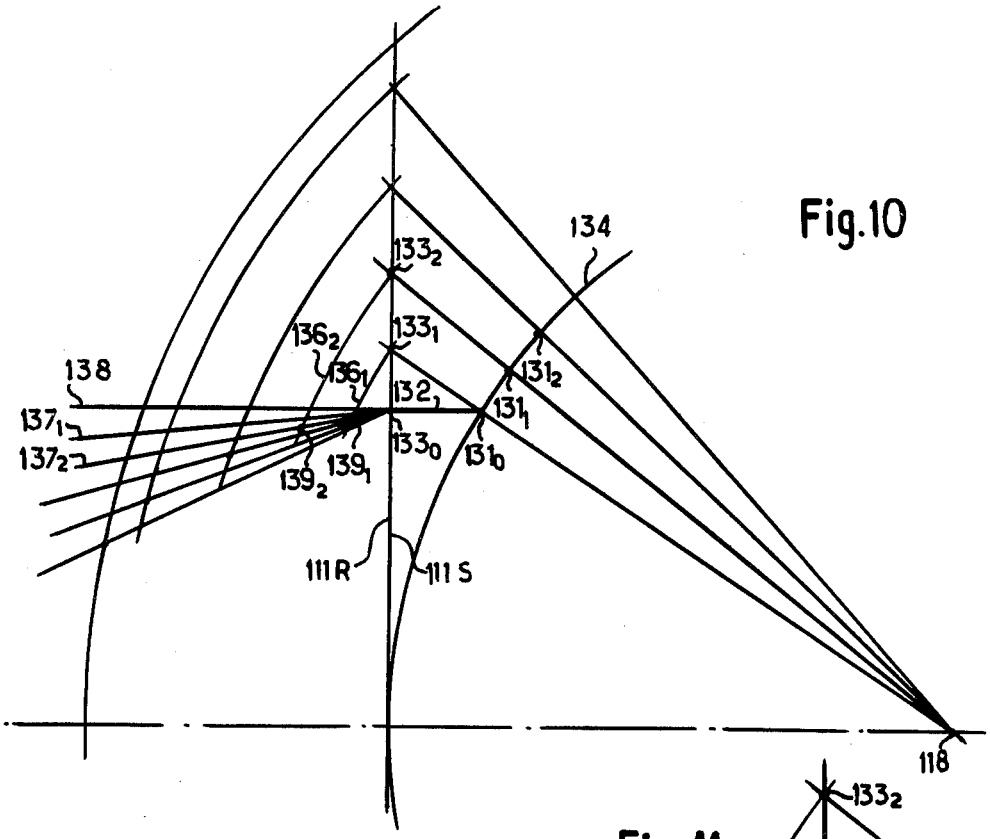
FIG. 10 is a graph illustrating the method of the invention for determining the vane contour which will result in the maximum output of the machine.
Figure 11:
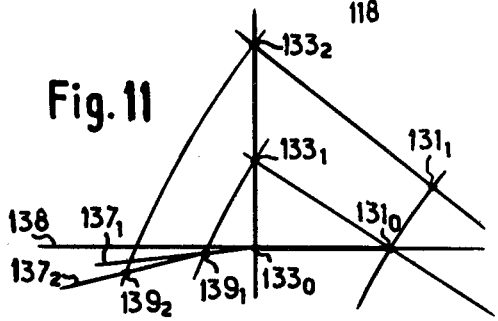
FIG. 11 is an enlarged portion of the graph of FIG. 4.

To this end, as shown in FIGS. 10–11, $131_0$ is the point of the attachment of portion 132 of a vane of a vane wheel which cooperates with the external face of the passage 121, that is to say, that which is the most distant from the axis of rotation 114 of the rotor in relation to the stator, the vane circulating in the passage clockwise as shown in FIG. 9. $133_0$ is the point of intersection of the attachment portion 132 with the trace 111 of the plane of sliding contact between the stator and the rotor and which determines, therefore, the depth of penetration of the vane into the passage.

The determination of the contour of the vane which corresponds approximately to the maximum output of the machine is thus carried on as follows:

On the circumference 134 representative of the body 135 of the vane wheel to which the vanes 119 belong, a point $131_1$ is chosen, angularly distant from the point $131_0$ by a predetermined angle, for example of 5°, if the determination is to be done with a precision corresponding to this angle. From the point $131_0$, a radius $118$–$131_0$ is drawn which intersects the straight line 111R at the point $133_1$. From the point $133_1$, an arc of circle $136_1$ is drawn, centered on the axis 118. This arc of a circle cuts a straight line $137_1$, which makes with the prolongation 138 of the attachment portion 132 an angle of 5°, in a point $139_1$. This point is a point of the side of the profile of the vane to be determined. From the point $139_1$, a straight line $137_2$ is drawn being in relation to the straight line $137_1$ at an angle of 5°, therefore, at an angle of 10° in relation to the straight line 138. Consider the radius $118$–$131_1$ at an angle of 5° in relation to the radius $118$–$131_0$. It intersects the straight line 111R at a point $133_2$ and the arc of the circle $136_2$, centered on the axis 118, intersects the straight line $137_2$ at a point $139_2$, which is another point of the contour of the vane.

Figure 13:
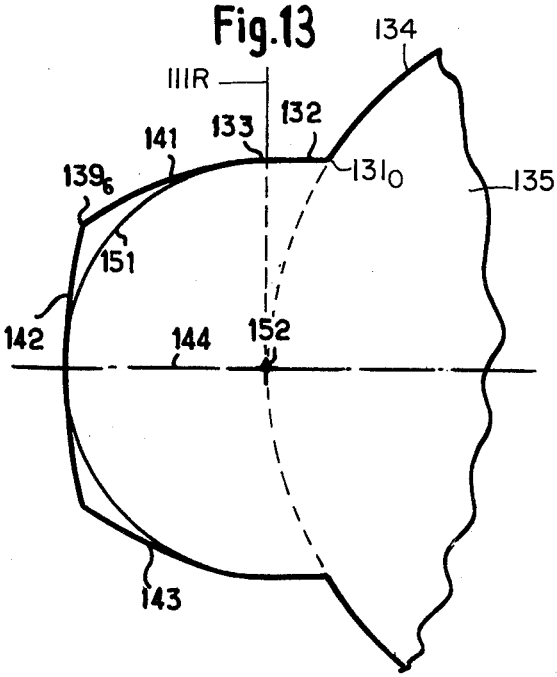
FIG. 13 is an enlarged view in elevation of a single vane of the vane wheel shown in FIG. 12.

To determine the complete contour of a lateral side 141 of the vane the same construction as aforedescribed is carried on, step by step which, in this example, leads to a point $139_6$ (FIG. 13), which is the extremity of the lateral side 141 of the vane. The frontal side 142 is an arc of a circle centered on the axis 118 and the opposite side 143 of the vane is symmetrical to the side 141 in relation to the mean line 144 of the vane. As can be seen in FIG. 13, the configuration of the vane member thus produced resembles that of a tooth of a gear having symmetrical incurved lateral sides 141, 143 resembling the involute curve of a circle and a frontal side 142 which is concentric to the axis of rotation of the vane wheel 135.

The contour of the transverse section of a passage of the stator is conjugated to that of the sides of the vane 141, 142, 143.

By its very construction, a passage of the stator having this contour as a transverse section can be obtained by casting with a one piece die, and the latter can be removed from the cast stator by a movement parallel to the axis of rotation 114 of the rotor in relation to the stator.

In an alternative embodiment, the construction explained above is carried out starting, not from the point $131_0$, but from the point $131_0$.

Figure 12:
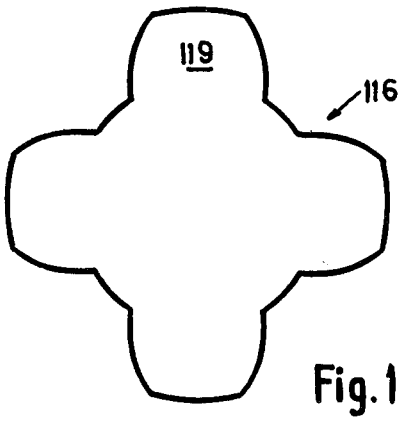
FIG. 12 is a view in elevation of a vane wheel having four vanes whose contour was determined by the method illustrated in FIGS. 10–11.

FIG. 12 shows a wheel 116 having four vanes 119 whose contours were determined as indicated above.

In another alternate embodiment, a vane of a vane wheel has a contour of a half-circumference 151, the center 152 of which is on the circle 134.

Figure 14:
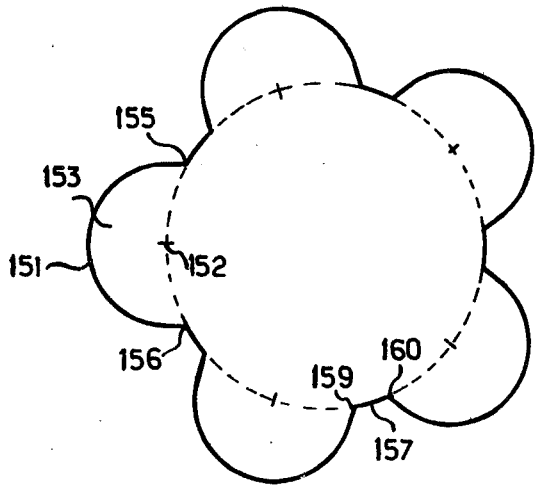
FIG. 14 is a view in elevation of a vane wheel having five vanes, each of a semi-circular contour.

FIG. 14 shows a vane wheel comprising five vanes 153 with a semi-circular contour, the extremities 155 and 156 of which are on the root circle 157 of the wheel. The radius of the half-circumference 154 is chosen such that the distance between the adjacent attachments 159 and 160 of two neighboring vanes give a wheel satisfying the aforesaid conditions.

In accordance with the present invention, there is also provided a method for determination of the contour of the slidingly cooperating surfaces of the stator and the rotor so as to achieve, for a vane wheel having vanes with a predetermined contour, a machine with maximum output having a stator which can be manufactured by casting with a die in one piece.

Figure 15:
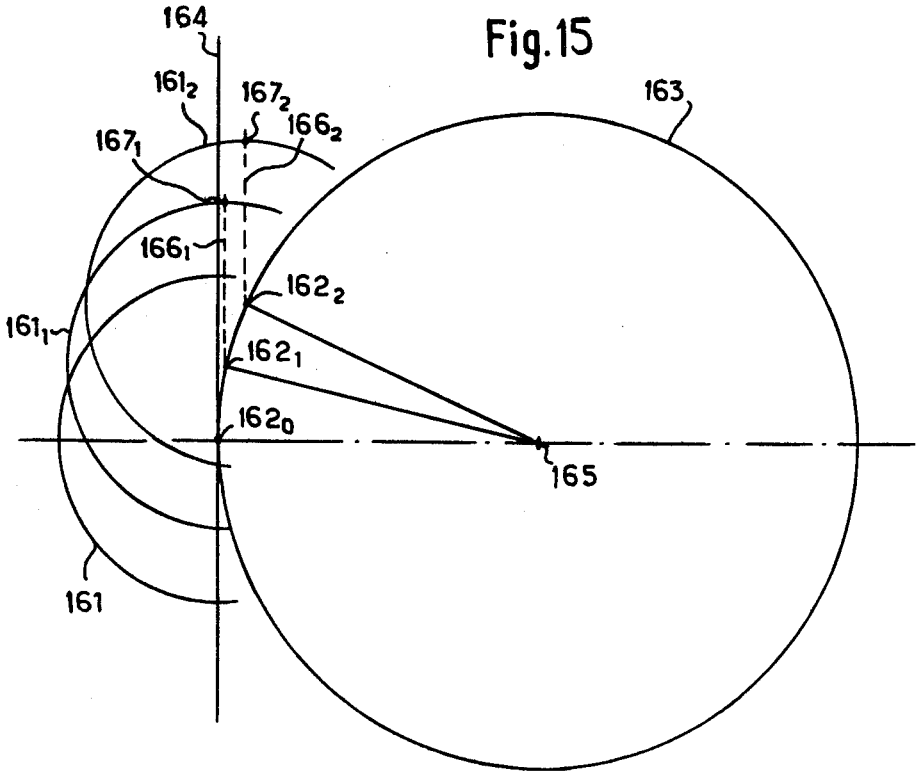
FIG. 15 is a graph illustrating the method of the invention for determining the configuration of the co-operating surfaces on the plate and support shown in FIG. 7 so as to provide, for a given vane contour, a machine having a maximum output.

To this end, there is shown in FIG. 15 a machine wherein the vanes of the vane wheels have a circular contour. A vane 161 with semi-circular contour has its center $162_0$ on the root circle 163 of the vane wheel. If 164 is the tangent to the root circle 163 of the vane wheel at point $162_0$, the profile and the cooperating surface of the stator corresponding to the maximum output of the machine whose rotor carries the vane wheels, are determined as follows: a point $162_1$ is chosen for which the radius $162_1$–165 (165 being the axis of the wheel) makes a predetermined angle, for example 5°, with the radius $162_0$–165. At $162_1$, considered as a center is drawn the half-circle $161_1$ representative of the vane after its rotation of the corresponding 5°. This half-circle $161_1$ meets the straight line $166_1$ parallel to the straight line 164, at a point $167_1$ which is a point of the surface of the stator cooperating with the rotor necessary to determine the depth of the passage.

As one continues in the same manner, a point $167_2$ is obtained at the intersection of the straight line $166_2$ parallel to the straight line 164 with the semi-circular contour $161_2$ corresponding to a circle whose center $162_2$ is again displaced by an angle, equal to the preceding one, for example, as shown on FIG. 15.

The profile of the surface of the stator and, consequently, of the surface of the rotor, each of which surfaces slide one on the other, is thus obtained, for which the output is maximum with vane wheels having vanes with semi-circular contour.

A similar construction can be made with a vane wheel having vanes with a contour which was defined in relation to FIG. 10.

The construction defined with reference to FIG. 10 can be used for the determination of the contour of a vane wheel, and consequently of the transverse section of the cooperating passages of the stator, in a machine in which the cooperating surfaces of the rotor and the stator, which slide one on the other to limit the channel for the circulation of the fluid, are other than flat surfaces.

What is claimed is:

1. In a positive-displacement rotative machine in which the conversion of pressure energy of fluids is obtained by the circulation of at least two spaced vane members in at least one spiral-like passage of revolution defined by rib members having top surfaces and side walls, wherein said vane members are parts of at least two vane wheels, each of said vane wheels is mounted for rotation about its own axis and housed in a slot formed in a first part of said machine, said vane members circulate in said spiral-like passages of revolution formed in a plate member comprising a second part of said machine, at least one of said first and second parts of said machine is rotatable, the axis of rotation thereof constituting the main axis of rotation of said machine, the axes of rotation of each of said vane wheels are transverse to said main axis of rotation of said machine, said spiral-like passages of revolution are generated by a combined rotation of said vane members about the axis of rotation of their respective vane wheels and by rotation of said first part of said machine in relation to said second part of said machine, whereby said side walls of said spiral-like passages have a constantly changing angle of inclination with respect to said main axis of rotation of said machine, said spiral-like passages are closed across the top surfaces of said rib members by a cooperating surface formed on said first part of said machine receiving said vane wheels in sliding contact therewith to thereby form channels for the circulating fluid, and said spiral-like passages each extend between a central inlet chamber and a peripheral outlet chamber formed in said plate member for the circulating fluid and have a continuous progressively varying cross-sectional area from the inlet to the outlet thereof, the improvement therein which comprises:

the width of said vane members at the point of attachment to the body of said vane wheels is greater than the width at the outermost frontal side thereof, and said spiral-like passages have a transverse section with corresponding dimensions to those of said vane members such that said side walls thereof diverge outwardly from the bottom thereof, the difference in width of said vane members between said frontal side and said point of attachment to the body of the vane wheel being sufficiently great such that for all different angles of inclination of said side walls of said spiral-like passages on said plate member there is at no point a negative rake with respect to a line parallel to said main axis of rotation of said machine;

whereby said plate member in which said spiral-like passages are formed may be die-cast with a one piece die.

2. A machine as claimed in claim 1, wherein said vane members have a contour approximating a half-circumference.

3. A machine as claimed in claim 1, wherein said top surfaces of said rib members formed on said plate member and the slidingly cooperating surface formed on said first part of said machine are flat.

4. A machine as claimed in claim 1, wherein said spiral-like passages are formed by separate rib members fixedly secured to said plate member, said rib members having a shape which is capable of being die-cast with a one-piece die.

5. A machine as claimed in claim 1, wherein said vane members of said vane wheels and said transverse section of said spiral-like passages have a predetermined contour permitting said passages to be cast on said plate, and wherein said top surfaces of said rib members and the slidingly cooperating surface formed on said first part of said machine are contoured, said cooperating contoured surface is determined by (a) drawing a tangent line to a first point on the circumference of the body of a vane wheel where the center line of the aforesaid vane member intersects therewith;

(b) marking a second point on said circumference at a predetermined angularly spaced distance from said first point and drawing a second line parallel to said tangent line;

(c) scribing a second side profile of said predetermined contour of said vane member with said second point on said circumference serving as the centerline thereof;

(d) said second side profile of said vane member intersecting said second line at a point on the contoured profile of the top surfaces of said rib members;

(e) repeating steps (b) and (c) at successive predetermined angularly spaced points along the circumference of the body of said vane wheel whereby the intersection of successive correspondingly spaced side profiles of said vane member with successive correspondingly spaced lines parallel to said tangent line constitute additional points on the contoured profile of the top surfaces of said rib members;

said contoured profile of said top surfaces of said rib members obtaining the maximum output for said machine having said vane members of said predetermined contour.

6. A rotative machine as claimed in claim 1, wherein said spiral-like passages have a transverse section which narrows towards the bottom thereof so that over the entire length of each of said passages the slope of the side walls thereof diverge from the bottom of the passage in relation to a direction parallel to the axis of rotation of said plate member, and said frontal side of said vane members is narrower than the portion thereof which is adjacent to the body of said vane wheels, thereby corresponding in shape to said transverse section of said passages.

7. A rotative machine as claimed in claim 6, wherein said spiral-like passages have a trapezoidal transverse section and said vane members have a corresponding trapezoidal shape.

8. A machine as claimed in claim 1, wherein said plate is made from a castable material.

9. A machine as claimed in claim 8, wherein the side walls and the bottom of said spiral-like passages are covered with a lining of plastic material obtained by one piece molds which at no point have a negative rake.

10. A rotative machine as claimed in claim 1, wherein the contour of said vane members and the corresponding transverse section of said spiral-like passages have incurved portions, thereby providing a maximum output from said machine while permitting said plate containing said passages to be die-cast with a one-piece die.

11. A machine as claimed in claim 3, wherein said contour of said vane members and the corresponding transverse section of said spiral-like passages is determined by (a) drawing a first straight line from a first point on the circumference of the body of a vane wheel where an edge of the base of a vane member most distant from the main axis of rotation of said machine is located perpendicular to a tangent line drawn to said circumference at a point where the center line of the aforesaid vane member intersects therewith;

(b) drawing a second straight line from said first point to said tangent line said second straight line extending from a radial line joining said first point to the center of said vane wheel body;

(c) scribing an arc of a circle whose radius is the distance from the center of said vane wheel to the point where said second straight line intersects said tangent line;

(d) drawing a third straight line from the point of intersection of said first straight line with said tangent line at an angle to said first straight line equal to the angle between said second straight line and a radial line joining said point of intersection to the center of said vane wheel body;

(e) said arc intersecting said third straight line at a point on the profile of the side of said vane member between said first point and the frontal side thereof;

(f) repeating steps (a) - (d) at successive predetermined angularly spaced points along the circumference of the body of the vane wheel whereby the intersection of successive arcs with successive extended lines correspondingly angularly spaced from said first straight line constitute additional points on the profile of the side of said vane member; and said frontal side of said vane member constitutes the arc of a circle whose radius equals the sum of the radius of the body of said vane wheel and one-half the width of the widest portion of said vane member, whereby at no point in said spiral-like passages formed on said plate member is there a negative rake with respect to a line parallel to said main axis of rotation of said machine and all points in said spiral-like passages have the maximum possible dimension so as to provide said machine with a maximum output.

12. A machine as claimed in claim 11, wherein said vane members have a configuration resembling a tooth of a gear having symmetrical incurved lateral sides shaped like the involute curve of a circle and a front side which is concentric with the axis of rotation of said vane wheel.

* * * * *